US005140918A

United States Patent [19]

Combepine et al.

[11] Patent Number: 5,140,918

[45] Date of Patent: Aug. 25, 1992

[54] SEWING MACHINE AND A METHOD OF MANUFACTURING A SEWING MACHINE

[75] Inventors: Michel Combepine, Les Avanchets; Antonio Jimenez, Meyrin, both of Switzerland

[73] Assignee: Mefina S.A., Fribourg, Switzerland

[21] Appl. No.: 729,852

[22] Filed: Jul. 12, 1991

Related U.S. Application Data

[63] Continuation of Ser. No. 535,142, Jun. 8, 1990, abandoned, which is a continuation-in-part of Ser. No. 338,120, Apr. 14, 1989, abandoned.

[30] Foreign Application Priority Data

Apr. 14, 1988 [CH] Switzerland ..... 1375/88

[51] Int. Cl.[5] ..... D05B 75/00

[52] U.S. Cl. ..... 112/258

[58] Field of Search ..... 112/258, 259, 260, 220

[56] References Cited

U.S. PATENT DOCUMENTS

D. 129,622 9/1941 Wonnacott ..... 112/258

3,420,200 1/1969 Johnson ..... 112/258

4,429,650 2/1984 Ishikawa et al. ..... 112/258

4,552,081 11/1985 Vartoukian et al. ..... 112/258

4,628,845 12/1986 Matsuda ..... 112/259

4,651,661 3/1987 Matsuda ..... 112/259 X

FOREIGN PATENT DOCUMENTS 63-50037 10/1988 Japan .

*Primary Examiner*—Werner H. Schroeder

*Assistant Examiner*—Paul C. Lewis

*Attorney, Agent, or Firm*—Cushman, Darby & Cushman

[57] ABSTRACT

A sewing machine having a composite frame includes plastic structure forming a support base of the machine and carrying a strong U-shaped framework detachably mounted by clamps. The branches of the U-shaped framework form respectively a part of a first and a second arm, the arms being horizontal and superpositioned and projecting out from the side of a column. The drive mechanism for the needle bar of the machine and the mechanism for feed of the sewing material and for the loop pick-up device are respectively associated with these arms.

5 Claims, 4 Drawing Sheets

SEWING MACHINE AND A METHOD OF MANUFACTURING A SEWING MACHINE

This is a continuation of application Ser. No. 07/535,142, filed on Jun. 8, 1990, which was abandoned upon the filing hereof, which is a continuation-in-part of Ser. No. 07/338,120, filed Apr. 14, 1989, now abandoned.

FIELD OF THE INVENTION

This invention relates to a sewing machine comprising a frame having at least two substantially horizontal arms. The first arm extends at least in part above the second arm. A needle bar and its drive mechanism are associated with one of the arms, and at least a sewing material feed mechanism and/or a loop pick-up device are associated with the other arm. The two arms project out from opposite ends and from the same side of a connecting column.

BACKGROUND OF THE INVENTION

Numerous sewing machines of this type are known in which the frame and the casing form a unit comprising, in its interior, in particular different support surfaces and bearings for various members of the machine, while its external surface is shaped in a manner corresponding to the "design" desired for the machine.

This type of frame-casing has been formed for a long time from metal and more recently from synthetic material, in particular plastics material, without however modification of the original concept.

It is true that adoption of plastics material has permitted a quite significant reduction in the cost of manufacture of frame-casings, but it has still not solved the major and long standing disadvantage of today's sewing machines, that is having to make use of different frames for each model of machine of different design.

A construction of sewing machine has also been proposed in which the frame and the mechanical parts that it carries are enveloped by a shell which serves only as a covering for the machine. Patent Specifications CH 257 357 and U.S. Pat. No. 3,420,200 illustrate this type of construction. The latter effectively brings improvements in the manufacture of sewing machines, since with one single type of frame it is possible to offer to customers an almost infinite number of models of different design, the different designs being dependent only on the appearance of the corresponding covering shells.

SUMMARY OF THE INVENTION

The present invention aims at further improving the process of manufacture and assembly of sewing machines and, more particularly, of their frames and casings, all the while obtaining as an added effect, a considerable reduction not only in the complexity of their construction and assembly but also in their weight.

Therefore, in the sewing machine which is the subject of this invention, the frame comprises, on the one hand, a structure forming a support base for the machine, and, on the other hand, a framework carried by this structure and having the general shape of a U, the branches of which form, respectively, at least part of the first and second of arms, and the base of which forms at least part of said column, whereby means are provided for connecting the framework to said structure in a detachable manner.

BRIEF DESCRIPTION OF THE DRAWINGS

The accompanying drawings represent, by way of example and very diagrammatically, one embodiment as well as diverse variants of the sewing machine according to the present invention.

DETAILED DESCRIPTION OF THE INVENTION

Figure 1:
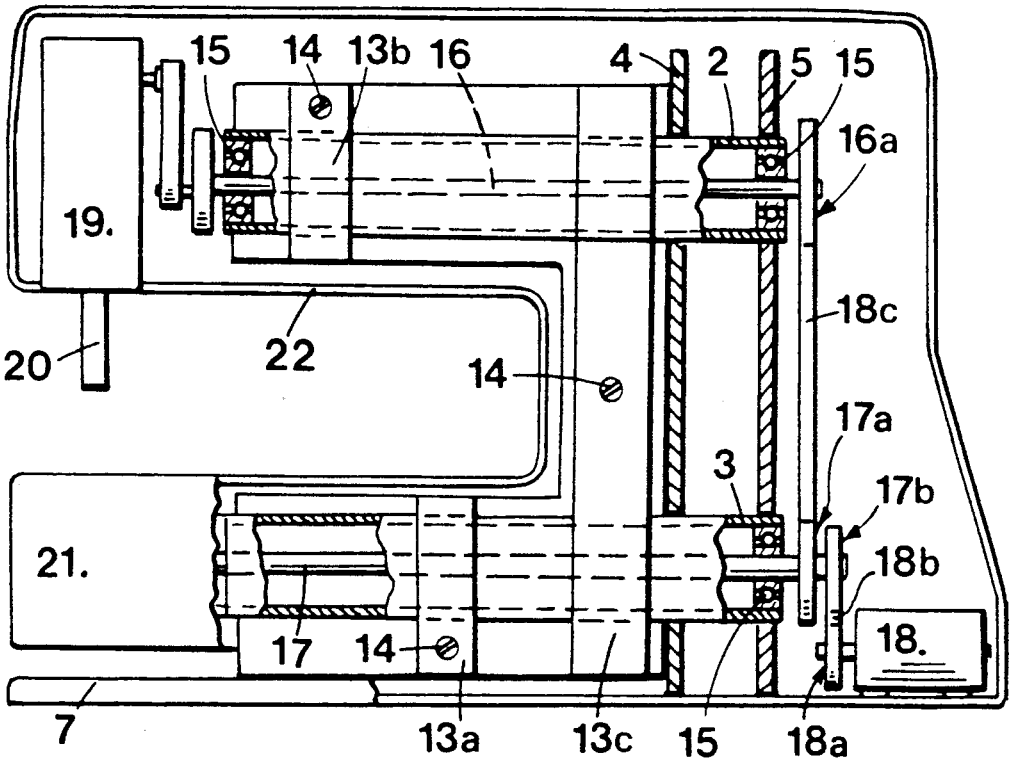
FIG. 1 is a view in elevation.
Figure 2:
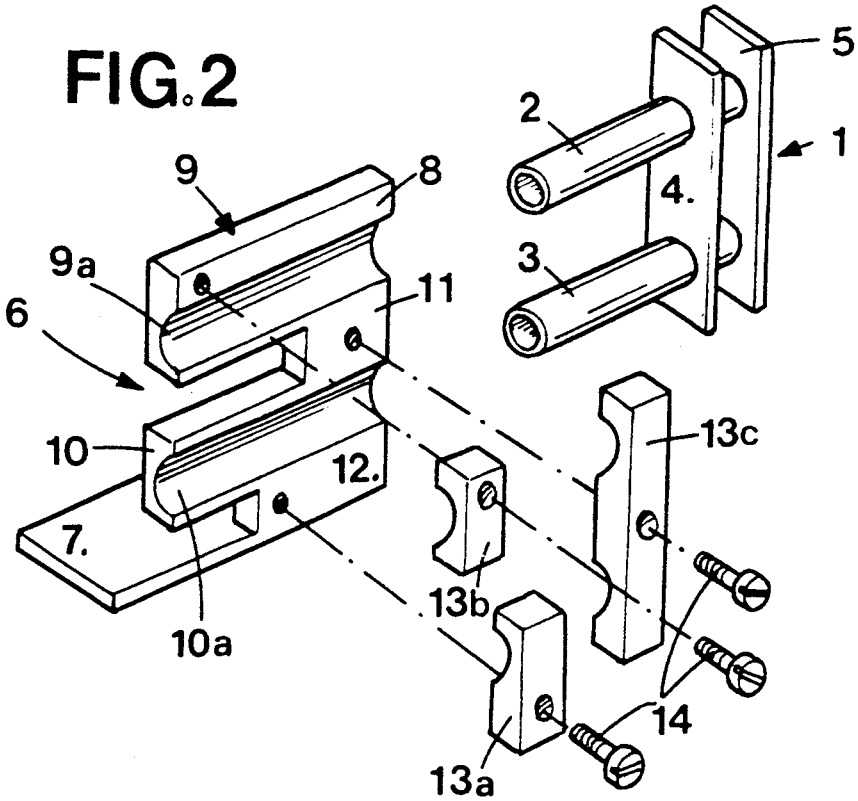
FIG. 2 is an exploded view of certain elements appearing in FIG. 1.
Figure 3A:
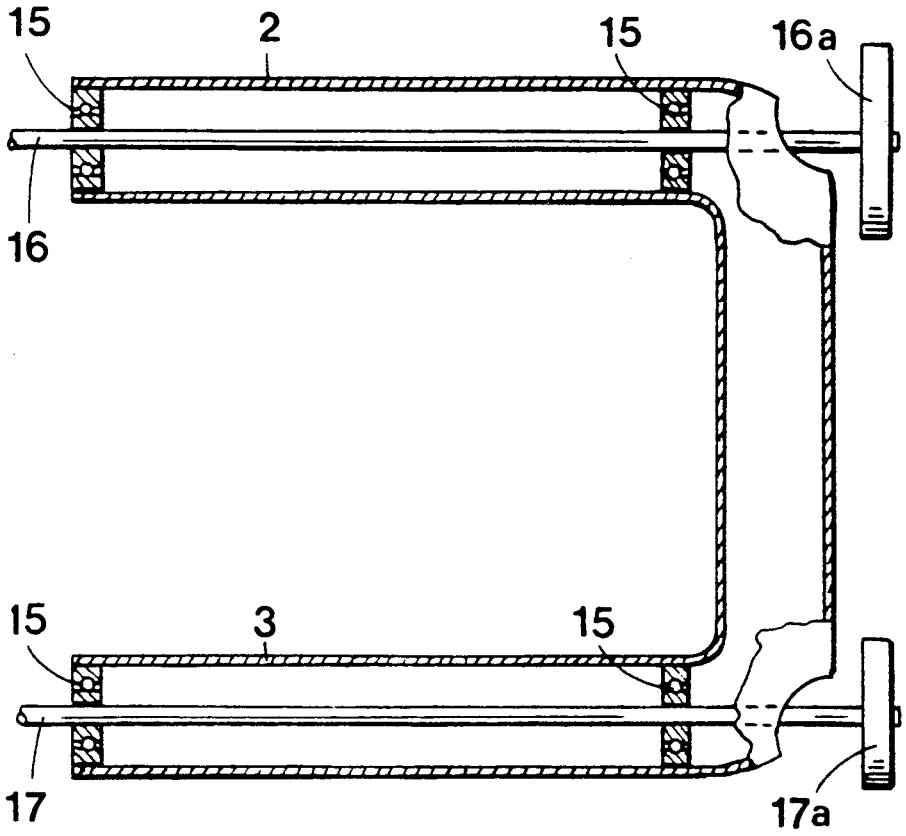
FIGS. 3A and 3B illustrate a first variant in detail.
Figure 3B:
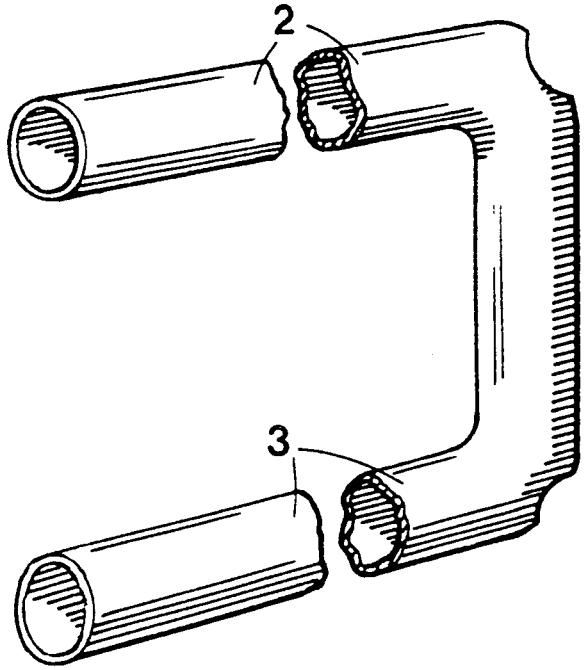
Figure 4A:
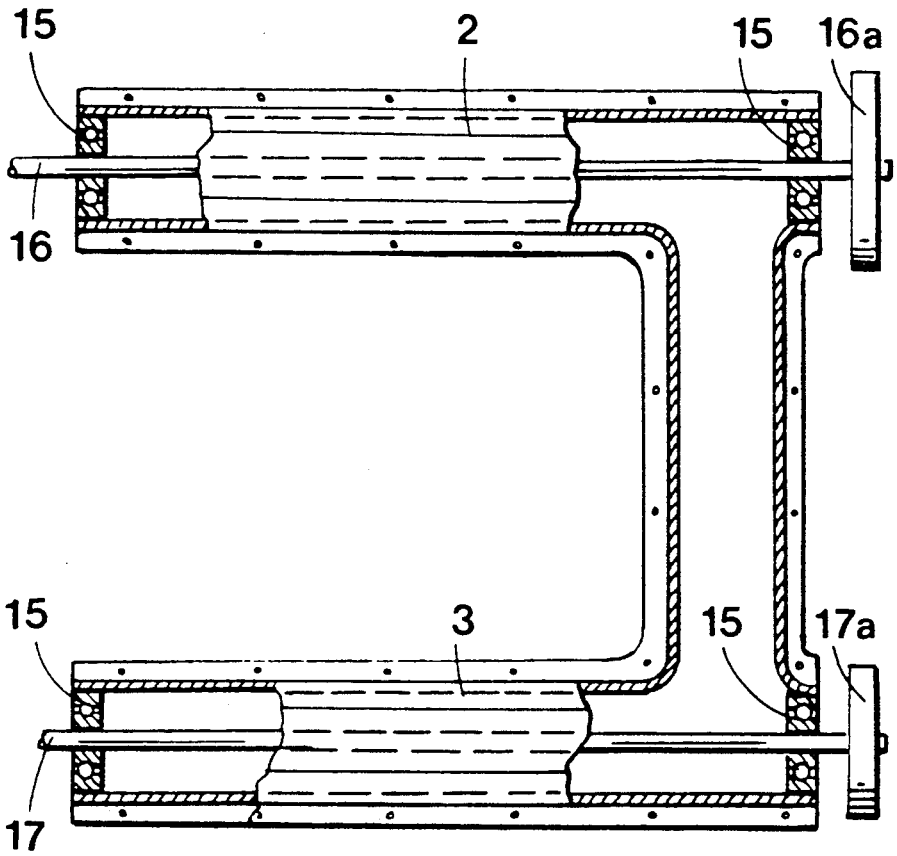
FIGS. 4A and 4B illustrate a second variant in detail.
Figure 4B:
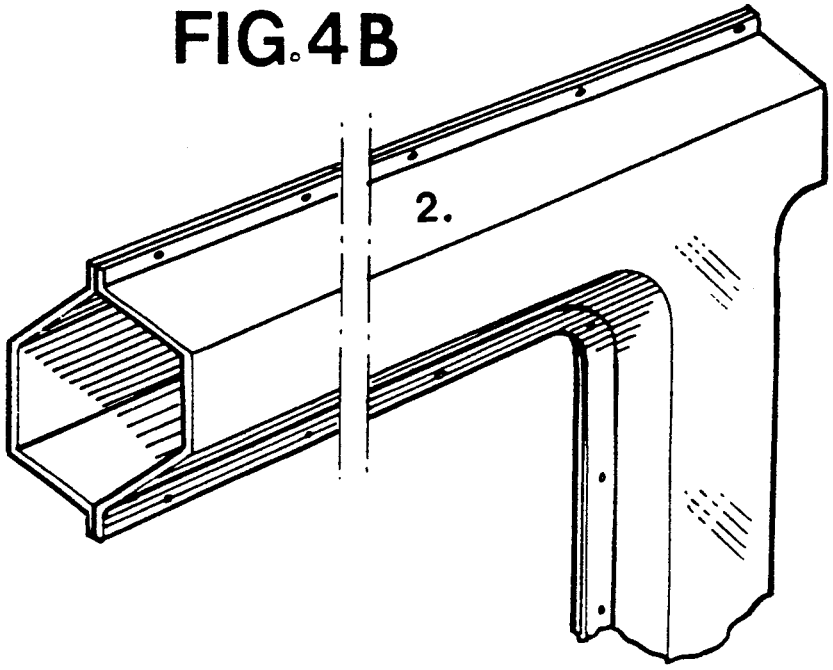

The sewing machine illustrated in FIGS. 1 and 2 comprises a frame whose essential characteristics have been represented diagrammatically in the exploded view of FIG. 2.

As may be seen, this frame comprises a strong framework 1 having two tubular arms 2 and 3, the right-hand ends of which, on the drawing, pass through two parallel plates 4 and 5, to which the arms are fixed by welding or by gluing, for example. These parts may be made from different materials, metallic or non-metallic: aluminium, or indeed alloys of this metal, or yet again other metals may be used. Reinforced composite materials, in particular polymer materials reinforced with filaments or fibers, for example with carbon, with Kevlar (Trade Mark), or with glass.

The frame of the machine also comprises a structure 6, for instance of synthetic material, in particular of plastics material, having the form of a flat base 7 on which stands a vertical plate 8 in the general shape of a U, the plate 8 having an upper arm 9 and a lower arm 10, lower arm 10 being connected to the first arm 9 by an intermediate portion 11 and to the base 7 by a connecting section 12. The arms 9 and 10 are parallel and horizontal, the first arm extending above the second. They are hollowed out over their entire length by recesses 9*a* and 10*a* respectively, the recesses being of semi-cylindrical shape and of a diameter more or less corresponding to the external diameter of the respective arms 2 and 3 of the framework 1.

In the assembled position, such as that shown in FIG. 2, the framework 1 is in effect rendered integral with the structure portion 6 by engagement of the tubular arms 2 and 3 in the recesses or grooves 9*a* and 10*a* and by tightening three clamps 13*a*, 13*b* and 13*c* secured to the structure 6 by respective screws 14. The first clamp 13*a* embraces the arm 3 of the framework 1, the second clamp 13*b* embraces the arm 2 of the framework 1, and the third arm 13*c* embraces both of the arms 2 and 3 of the framework 1.

The structure 6 as well as the clamps 13*a*, 13*b* and 13*c* may be formed for example by molding from any suitable synthetic material, in particular plastics material such as for example polyethylene terephthalate (PETP), in particular that of Du Pont sold under the name Rynite (Trade Mark), filled with 30 to 55% fibers, especially glass fibers, the molding temperature being between 260° and 300° C. Another PETP from Bayer, Pocan B (Trade Mark), filled with 30% glass fibers or other fillers, may also be used.

Furthermore use may also be made of a crystalline polyester such as the product sold by Rhone-Poulenc under the name Teschster (Trade Mark) T 20 000 VM 45 or E 20 021 V 35, filled in particular with 20 to 30% glass fibers, the molding temperature being from 230° to 300° C.

Nylon, of the polyamide 6.6 type, may likewise be used, in particular that marketed by Schulman under the name Schulamid (Trade Mark), filled with 35 to 50% glass fibers or other fillers and molded at a temperature of 280° to 300° C.

Of course, other plastic materials may be used, in particular hot or cold polymerisable plastics. Expanded polymers such as polyurethane foams or other foams rigid at ambient temperature may also be used.

At each end of the tubular arms 2 and 3, the sewing machine has a roller bearing 15 forming a support for two drive shafts 16 and 17, passing through the tubular arms 2 and 3 respectively.

These are driven in a manner known to one skilled in the art by a motor 18 through pulleys 16*a* and 17*a*, mounted at the projecting right-hand ends of the shafts 16 and 17, and pulleys 17*b* and 18*a*, mounted on the shaft 17 and on the shaft of the motor 18, respectively, and by two belts 18*b* and 18*c*.

The left-hand ends of the shafts 16 and 17, as shown in FIG. 1, respectively drive in a known manner a drive mechanism for the needle bar of the machine, shown by rectangles 19 and 20, and a sewing material feed device and a loop pick-up device shown by rectangle 21. These various mechanisms and devices and the manner in which they are driven by respective drive shafts are well-known to those of ordinary skill in the art and will not be described here.

The construction which has just been described facilitates, in a manner unknown until now, both the manufacture and the assembly of a sewing machine by making use of materials and structures that are exceptionally light in weight and sufficiently strong.

As described above, the frame of the present sewing machine is in fact formed of two main parts, that is to say a lightweight structure portion 6 of plastic material, the base 7 of which enables the machine to be positioned for example on a table, and a lightweight strong framework 1 fixed to the structure portion 6 by simple clamps such as the clamps 13*a* to 13*c*.

This simple architecture in practice offers a full guarantee of safety in regard to withstanding forces to which the sewing machine may be subjected: in particular, almost all of the forces applied to the sewing machine during sewing operations are transmitted by the shafts 16 and 17 to the strong framework 1 whose moment of inertia is particularly great, since this framework is formed from tubular members 2 and 3 made integral by the plates 4 and 5. These forces remain confined within the framework.

It is to be noted that these members may have a different cross-section from the annular shape described. In particular use may be made of tubular elements of polygonal cross-section, triangular or square for example.

As a variant, the framework may even be formed entirely by a tubular element in the form of a U: FIGS. 3A and 3B and 4A and 4B respectively show in particular elements of this type.

The structure portion of synthetic material thus carries only a small force during sewing operations; it will however be dimensioned and formed in synthetic material, reinforced or non-reinforced, such as those previously mentioned, to offer sufficient resistance to the shocks to which the sewing machine may be subjected during operations of manipulation and of transport, for example.

Considering now the actual assembly, the construction described renders this particularly easy and quick. It is in fact possible to form, independently and even in places very distant from each other, the structure portion of synthetic material, the framework assemblies—roller bearings—shafts 16, 17, pulleys 16*a* and 17*a* and the mechanisms 19 to 21, which may be prepared in monobloc form.

On a work surface, a structure portion 6 is disposed in a lying position in such a manner that its grooves 9*a* and 10*a* appear side by side in a substantially horizontal position. An assembly of the above type is placed on the structure 6 by introducing its arms 2 and 3 into the recesses 9*a* and 10*a* respectively. The clamps 13*a* to 13*c* are then placed over these arms to secure them to the structure portion 6 by means of the screws 14. The framework 1 is thus correctly positioned and fixed on the structure 6. It may be detached very easily, in case of need, by simply unscrewing the screws 14.

The mechanisms 19 and 21 are then attached to the structure portion 6 in any known manner and are connected kinematically to the shafts 16 and 17 respectively in a manner known in the sewing machine art.

Finally the belts 18*a* and 18*b* are mounted on the respective pulleys.

As may be seen, this manner of carrying out the assembly proves to be particularly rapid and certain in regard to the quality of the result obtained and in respect of its reliability from machine to machine.

Advantageously, the rear surface, in the drawing, of the structure portion 6 forms a portion of the rear part of the casing of the sewing machine described. This casing is completed by a casing portion 22, represented diagrammatically in FIG. 1, which covers up the other structural elements of the machine and may be secured to the structure portion 6 by any known means.

Figure 5:
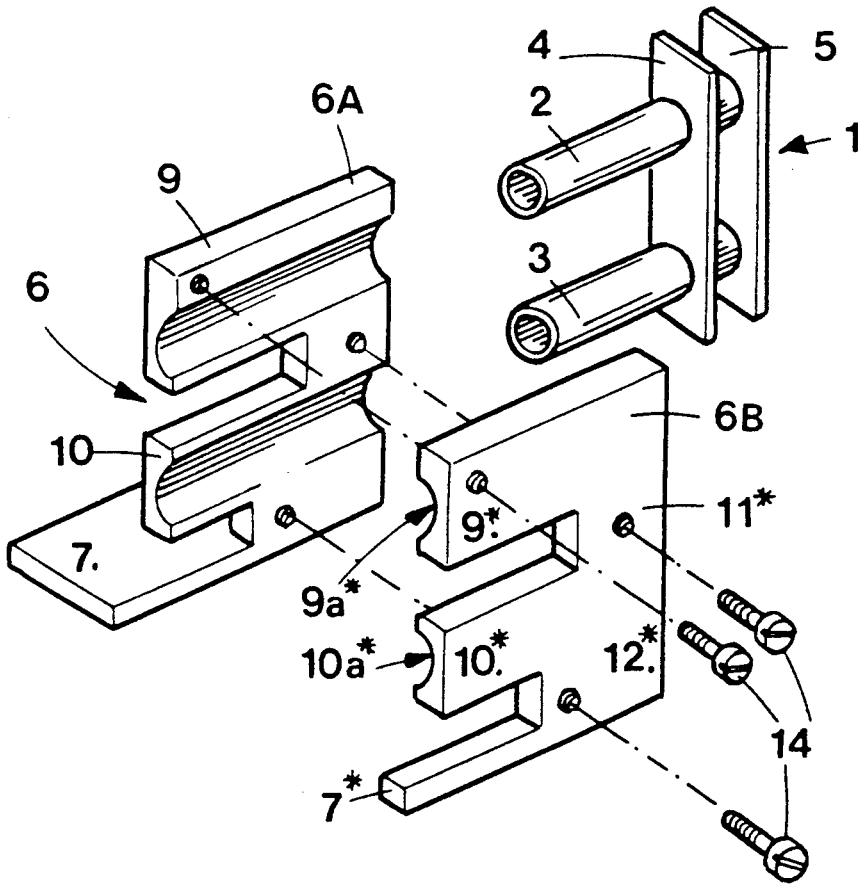
FIG. 5 is a view similar to that of FIG. 2 of a variant of embodiment of the sewing machine according to the invention.

In the embodiment shown in FIG. 5, the structure portion 6 is formed by two shells 6A and 6B capable of being assembled in a jointed manner about the frame 1 by means of screws 14.

As may be seen in the drawing, the shell 6A has a structure identical with that of the shell 6 previously described with reference to FIG. 2.

The structure of the shell 6B is almost identical to that of the shell 6A regarding the nature and the shape of the elements which form it. These elements are however designed according to an opposite symmetry.

On the shell 6B, there is to be found a portion of the base 7* as well as arms 9* and 10*. These arms are connected to each other by a part 11* and to the base 7* by a connecting section 12*. As for the shell 6A, the arms 9* and 10* are parallel and horizontal and are hollowed out along their entire length by grooves 9*a and 10*a. These grooves or recesses are themselves of semi-cylindrical shape and have a diameter substantially corresponding to the external diameter of the arms 2 and 3 of the framework 1.

Moreover, it should be indicated that the dimension of the assembly of the elements described is identical to that of the corresponding elements of the shell 6A such that in the assembled position of the shells 6A and 68 the recesses 9*a* and 9*a and 10***a* and 10*a respectively are located opposite one another, two by two, and also form two perfect cylindrical recesses for the arms 2 and 3 of the structure portion 1**.

It should be noted that in another variation, not shown, the shells 6A and 6B of the structure portion 6 may very well be made integral in the assembled position simply by gluing rather than by screws 14*.

Of course, the frame 1 may in this case also be in any of the forms that are the subject of FIGS. 3A and 3B and 4A and 4B respectively.

The invention is not limited to that which has been represented in the drawings and in the description which refers to them. It should be noted, in particular, that all of the possibilities envisaged for providing the frame could also be used "mutatis mutandis" in the construction of frames of sewing machines without a free arm, i.e. machines called "base" machines, that is to say machines in which the work surface is formed by a portion of the lower arm, which itself also forms the base.

Similarly, use could be made of the structural principles described for the provision of frames intended for plate machines to be housed in a piece of furniture or a work table for example.

We claim:

1. A sewing machine structure comprising:

a shell means having first and second parallel extending arms, an interior surface and positioning means disposed on said interior surface, drive means for a needle bar being housed within said first arm, a first means for feeding material to be sewn and a second means for loop capture being housed within said second arm, drive means for said first and second means also being housed within said second arm;

a U-shaped frame member supported by said positioning means relative to said interior surface, said frame member including first and second tubular branches and a member connecting said branches to define a U-shape, said first branch extending along a portion of said first arm and said second branch extending along a portion of said second arm, said first branch housing at least part of the drive means for said needle bar, said second branch housing at least part of the drive means for said first and second means; and mounting means for mutually fastening said shell means and said frame member, said mounting means including seats spaced apart on said interior surface for receiving said first and second branches of said U-shaped frame member and means for engaging and anchoring said first and second branches of said U-shaped frame member to said interior surface.

2. The sewing machine as claimed in claim 1, wherein said member connecting said branches comprises a tubular structure.

3. The sewing machine as claimed in claim 1, wherein said member connecting said branches of said U-shaped frame member comprises two parallel plates extending between said branches.

4. The sewing machine as claimed in claim 1 in which said shell means includes first and second shell members each including a plurality of recesses which, when said first and second shell members are assembled to form said first and second parallel extending arms, said recesses of one of said shell members are placed in juxtaposition to a recess of said other shell member wherein said facing recesses define positioning seats for receiving said branches of said U-shaped frame member.

5. The sewing machine as claimed in claim 3, wherein said two parallel plates each have a first and second pair of aligned holes formed therein and said first tubular branch is inserted through said first pair of holes and said second tubular branch is inserted through said second pair of holes to define said U-shaped frame.

* * * * *